United States Patent [19]

Bork

[11] Patent Number: 4,530,492

[45] Date of Patent: Jul. 23, 1985

[54] APPARATUS FOR SUPPORTING VEHICLE BODY PARTS

[76] Inventor: Robert L. Bork, 27408 Church Rd., Burlington, Wis. 53105

[21] Appl. No.: 498,074

[22] Filed: May 25, 1983

[51] Int. Cl.[3] ..... B66F 5/04

[52] U.S. Cl. ..... 269/17; 269/71; 269/296

[58] Field of Search ..... 414/763, 783, 458, 399, 414/391, 392; 269/17, 71, 45, 296; 254/45

[56] References Cited

U.S. PATENT DOCUMENTS 2,189,010 2/1940 Lewis .
2,955,632 10/1960 Stone .
3,218,056 11/1965 Kaplan et al. ..... 269/17
4,239,197 12/1980 Olstad .
4,383,681 5/1983 Walters ..... 269/17

*Primary Examiner*—Robert C. Watson
*Attorney, Agent, or Firm*—Arthur J. Hansmann

[57] ABSTRACT

Apparatus and method for supporting vehicle body parts to be worked upon, and the method includes the steps of supporting a vehicle body part, such as a car door, on a mobile jack and moving the body part to apparatus which supports the body part after the apparatus is withdrawn. The apparatus includes an enclosure frame which is horizontally disposed and which has two separable sections so that the body part can be placed within the confines of one of the sections, and the other section can then be assembled with the first section for completely supporting the vehicle body part for working thereon.

10 Claims, 1 Drawing Figure

APPARATUS FOR SUPPORTING VEHICLE BODY PARTS

This invention relates to apparatus and method for supporting vehicle body parts, such as doors, trunk lids, hoods, fenders, and the like for working on them.

BACKGROUND OF THE INVENTION

The present invention is described as utilizing the prior art floor-supported mobile hydraulic-type jack which is used in connection with automotive work. The jack is utilized herein for supporting a car door, for instance, while it is detached from the car, and the jack and the door are then moved to the apparatus of this invention which receives the vehicle part, such as the car door, in a supported and rotatable position so that it can be worked upon. The use of the mobile type of hydraulic jack for automotive is shown in U.S. Pat. No. 2,189,010, for an example. Also, U.S. Pat. Nos. 2,955,632 and 4,239,197 show supporting apparatus for building doors which can be rotated into various positions while being supported for working thereon.

The present invention differs from the prior art in that it is both a method and apparatus for supporting the vehicle body parts, and having them supported in either a set position or in a rotated position, according to the desired convenience of the work being performed on the part. In accomplishing this objective, the present invention provides for complete mechanical support of the vehicle body part, such as a vehicle door, from the very moment that it is released from the vehicle and to its position in the supporting apparatus of this invention. That is, one need not lift the part, such as the vehicle door, but instead it is supported on a hydraulic-type of floor jack which can then move the car door to the apparatus which will receive it and permit it to be maneuvered into various positions for working thereon.

Another improvement in object is to support a vehicle body part, such as a vehicle door, on the opposite ends thereof and utilizing the portions or openings of the door itself for the purpose of mounting the door. Still further, the support of this invention is adjustable to accommodate the different sizes and dimensions found in various vehicle body parts, such as car doors and the spacings of their hinges and latch openings and the like.

DETAILED DESCRIPTION OF THE APPARATUS AND METHOD

Figure 1:
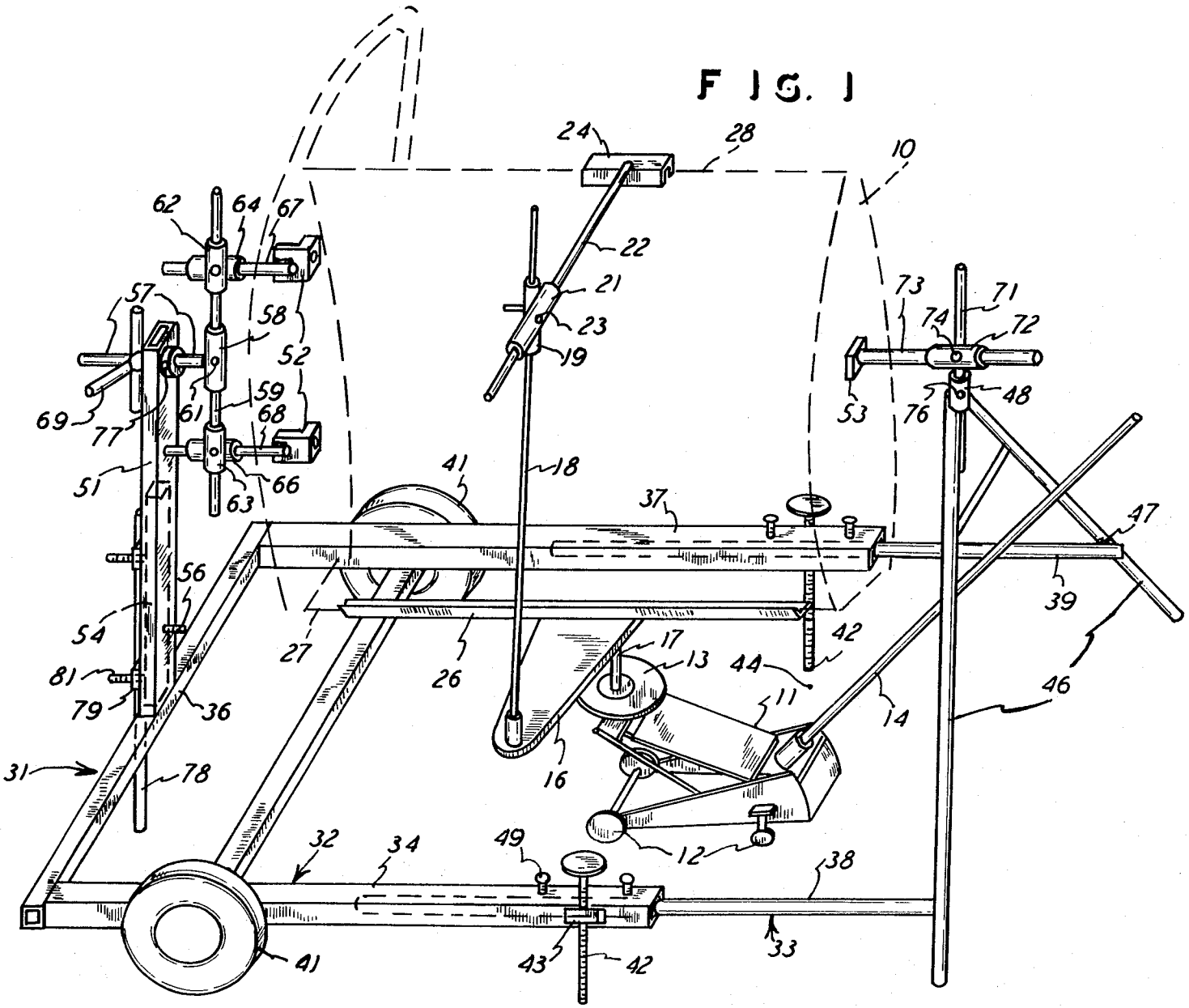
FIG. 1 is a side perspective view of the apparatus of this invention and showing a jack and also a vehicle door in dotted lines.

A vehicle door is shown in dotted lines and designated 10, and it is shown removed from the unshown vehicle. Removal is accomplished by means of a conventional type of hydraulic and floor mobile jack 11 which has wheels 12 for moving across the floor and which has a support plate 13 for lifting up on objects. Also, a handle 14 is a part of the jack and is available for pumping and steering the jack, in the usual manner. A plate 16 is fitted to the jack and is supported thereon by an upright 17 extending off the plate 13 so that the plate 16 is firmly positioned in a horizontal plane, but is available for up-and-down movement in the usual operation of the jack. An upstanding rod 18 is affixed with the end of the plate 16 and extends upwardly therefrom and supports a sleeve 19 which in turn is connected with a sleeve 21 into which a rod 22 is positioned. Thus, the sleeve 19 can move up-and-down on the rod 18, and the rod 22 can move horizontally in the sleeve 21, and both rods 18 and 22 can be held in fixed positions on their respective sleeves, such as by the shown set screw 23 on the sleeve 21. A bracket 24 is affixed to the end of the rod 22 and is basically horizontally oriented, as shown.

Thus, the jack 11 is utilized to move to the vehicle and to be positioned underneath the open door suspended on the vehicle, and a support 26 is affixed to the plate 16 and engages the door lower edge 27 to hold the door upwardly. Also, the bracket 24 engages the door upper edge 28 to hold the door from tipping. In that manner, the door 10 is completely supported by means of the jack 11. With the door supported, the door hinges (unshown) can be removed so that the door 10 is free of the vehicle, and the door can then be transported across the floor by means of the jack 11 which is fully supporting and holding the door 10.

The method continues, and the apparatus is shown in FIG. 1 to include the horizontally disposed frame generally designated 31 which includes the one section or piece generally designated 32 and the other section or piece generally designated 33. The frame presents the rectangular and horizontally disposed configuration of the shown rectangular tubes 34, 36, and 37 and the tubes 38 and 39 which are telescoped with the rectangular tubes 34 and 37, as shown. Thus, a horizontal frame is presented and is spaced above the floor by means of the floor engaging wheels 41 and the adjustable screws 42 which are suitably mounted on the pieces 34 and 37 by means of brackets 43 and are threaded for vertical adjustment as indicated.

Therefore, the support section 32 presents a general U-shaped configuration with the legs 34 and 37 and the base piece 36 of the square tubing, and it has an opening at the location designated 44 which is the location of the jack 11 as seen in FIG. 1.

The support section or piece 33 also includes the triangular arrangement of the two legs 46 which are fixedly attached to the extending ends of the frame pieces 38 and 39, such as by welding at 47, and the legs 46 extend in a vertical plane and are spaced apart to be joined together at their upper ends where a sleeve 48 is affixed thereto in a vertical orientation. With that arrangement, the support section 32 can be self-supporting in its horizontal orientation spaced above the floor, and the section 33 can be completely removed from the section 32 and then the vehicle door 10 along with the jack 11 can be moved into the confines of the section 32 to the position shown in FIG. 1. That movement is by rolling the jack 11 on the floor by means of the wheels 12, and thus the door 10 does not have to be manually lifted or carried. Subsequently, the support section 33 can be positioned as shown in FIG. 1, and the frame horizontal pieces 38 and 39 can be secured with the frame pieces 34 and 37, such as by means of set screws 49, as shown. Next, the door 10 can be secured to the support, in a manner shown in the drawings and hereinafter described, and the jack 11 can then be released from the door by lowering the support 26 and releasing the bracket 24, and the jack 11 can then be pulled out between the angled legs 46, leaving the door 10 in the position shown.

The support shown thus has a standard formed by the legs 46, and it also has a standard 51 on the frame piece 32, and thus there are two upright standards on opposite ends of the apparatus shown. The upper ends of the standards support connectors 52 and 53, respectively, which attach to the door 10, such as by having the connectors 52 engage the door hinges or hinge openings, and the connector 53 engaging the door latch or its opening in a manner which would be apparent to anyone skilled in the art.

The standard 51 is supported on an upright 54 affixed with the frame piece 36 and having the piece 51 extending thereover to be slidable up-and-down on the piece 54, such as by mating of two rectangular pieces, as shown. Thus, the connectors 52 can be moved up-and-down, and a set screw 56 can secure the standard 51 in any desired elevated position to adjust to the height for working on the door 10 when supported on the apparatus described. A shaft 57 is rotatably supported in the upper end of the piece 51 and fixedly carries a sleeve 58 which in turn receives a pipe 59 extending generally vertically in the orientation shown. The pipe 59 can slide up-and-down, and a set screw 61 can secure the pipe 59 in any desired elevated position. The ends of the pipe 59 carry sleeves 62 and 63, and they in turn are affixed to sleeves 64 and 66, respectively. Sleeves 64 and 66 in turn carry shafts 67 and 68 which are affixed to the connectors 52. Thus, the shafts 67 and 68 can slide in their respective sleeves 64 and 66, and also the sleeves 62 and 63 can slide independently up-and-down on the pipe 59, all for complete adjustment and positioning of the connectors 52 relative to the door 10. A handle 69 is on the shaft 57 and is thus available for rotating the shaft 57 and its support on the standard 51 to thus rotate the sleeve 58 and the respective sleeves and shafts related to the connectors 52. In that regard, the door 10 can be rotated through 360 degrees for positioning in any desired position for working thereon.

The standard 46 has a pipe 71 vertically slidable in the sleeve 48, and it carries a sleeve 72 affixed thereto, such as by welding, which in turn has a shaft 73 slidable therein and secured thereto by set screw 74. Thus, the shaft 71 can be moved up-and-down relative to the sleeve 48 and put in a fixed position, such as by a set screw 76, and the shaft 73 can be moved horizontally, relative to the sleeve 72, all for positioning the connector 53 relative to the door 10, as mentioned. Further, the shaft 73 serves as an axis for the rotation of the door, and that shaft is on the same horizontal axis as the shaft 57, so that the door can be rotated about that horizontal axis as desired, and it can also be held in any rotated position by means of the set screw 74 and a set screw 77 operating on the shaft 57.

With that description, the apparatus and embodiment are disclosed to anyone skilled in the art, and it will be seen and understood that there is a horizontally disposed frame 31 which includes the two sections or pieces 32 and 33 and the two standards 46 and 51 on each of the two sections. Also, the upper ends of the respective standards carry the connectors 52 and 53 which are fully adjustable, as described, for attaching to the vehicle body part, such as the door shown and described. The frame described as basically of an endless enclosure type which has the two opposite end sections 32 and 33 which are separable so that the door can be moved into the position shown, and there is also the opening 44 for the withdrawal of the jack 11 by pulling it along the floor, as described. Further, by means of the floor supports 42 the section 32 is self-standing and horizontally supported without the section 33, and thus the vehicle body part can be positioned when the section 33 is removed. The two sections 32 and 33 are readily disassembled with the removal of the section 33 so that the door 10 can be positioned as shown, and the section 33 can then be positioned as shown in FIG. 1 and the jack 11 can be released and withdrawn through the spaced-apart legs 46. At no time is it required that the user lift any of the vehicle parts, and also the vehicle parts are completely rotatably through 360 degrees on the apparatus described for working thereon, and they are also set in any angulated position when desired. Another leg 78 is attached to the standard 51 by means of brackets 79 for engaging the floor and providing additional stability to the entire apparatus, as indicated. Set screws 81 render the leg 78 vertically adjustable.

For purposes of pulling the jack 11 away from the car door 10 and through the opening 44 between the legs 46, the upstanding rod 18 can be removed from the plate 16, if and when necessary for clearance between the legs 46, and of course the horizontal rod 22 can also be repositioned or moved from the position shown in FIG. 1 for that clearance. The frame pieces 32 and 33 are shown to define a clear central space extending endlessly upwardly from the floor within the sides 34, 37, 38, and 39, and the end 46 and the frame wheel axle for wheels 41. Then, only the connectors 52 and 53 extend to that clear central space. With that arrangement, the door 10 can be wheeled into that central space.

What is claimed is:

1. Apparatus for supporting a vehicle door, comprising a horizontally disposed floor-supported frame including two pieces which are releasably attached together to present opposite ends of said frame and defining an endlessly vertically extended clear central space from the floor upward, one of said two pieces having floor supports thereon at opposite ends thereof for horizontal free-standing positioning of said one piece on the floor when detached from the other of said two pieces, a wheel-supported holder for mobily supporting said door, said one piece being open at one end thereof when detached from the other of said two pieces for receiving said door moved horizontally into the confines of said one piece by said wheel-supported holder, each of said two pieces including a standard extending uprightly thereon at said opposite ends, and connector means on each of the two of said standards and extending to said clear central space for attaching to said door.

2. The apparatus for supporting vehicle body parts as claimed in claim 1, wherein said means includes two said connectors on one of said standards and being spaced from each other for simultaneous attachment to said door, and said means includes a rotation connector interposed between the other of said standards for rotation of said door.

3. Apparatus for supporting a vehicle door, comprising a floor-supported frame of an endless enclosure configuration and having two opposite end pieces releasably connected together and defining an endlessly vertically extended clear central space from the floor upward, a standard mounted on each of said end pieces and extending uprightly therefrom, a connector means on the upper end of each of said standards extending to said central space and being for releasably connecting to said door, floor supports connected to one of said two pieces in spaced positions thereon for horizontal free-standing of said one piece when disconnected from the other of said two pieces, a floor-mobile holder for supporting said door and moving said door into said space, and said one piece having an open end at the location of said other piece for horizontally receiving said door when said one piece is disconnected from said other piece.

4. The apparatus for supporting a vehicle body part as claimed in claim 3, wherein said means includes two said connectors on one of said standards and being spaced from each other for simultaneous attachment to said door, and said means includes a rotation connector interposed between the other of said standards for rotation of said door.

5. The apparatus for supporting a vehicle body part as claimed in claim 3, wherein said other piece has a configuration which defines an opening with the floor and with said opening being of a size sufficient to allow said floor-mobile holder to pass through said opening.

6. The apparatus for supporting a vehicle body part as claimed in claim 3, wherein said other piece includes spaced-apart legs supportable on the floor and defining an opening of a size larger than said floor-mobile holder to allow said floor-supported holder to pass through said opening.

7. Apparatus for supporting a vehicle door, comprising a first frame piece having a horizontally disposed U-shape, floor supports attached to said first frame piece for supporting said frame piece in the horizontal orientation, a second frame piece having horizontally spaced-apart members connected to the extending legs of the U-shape of said first frame piece, said frame pieces defining an endlessly vertically extending clear central opening upward from the floor, a standard mounted on each of said frame pieces and extending upwardly therefrom, a connector attached to each of said standards and extending to said central space for connecting to said door to support said door, a floor-mobile door holder for holding said door, and said frame pieces being releasably connected together for removal of said second frame piece from said first frame piece to thereby expose said extending legs for movement of said door into said central space while said door is being held on said mobile holder.

8. The apparatus for supporting a vehicle body part as claimed in claim 7, wherein said means includes two said connectors on one of said standards and being spaced from each other for simultaneous attachment to said door, and said means includes a rotation connector interposed between the other of said standards for rotation of said door.

9. The apparatus for supporting a vehicle body part as claimed in claim 7, wherein said second frame piece includes spaced-apart legs supportable on the floor and defining an opening of a size larger than said holder and adequate to allow movement of said floor-mobile holder to pass through said opening.

10. The apparatus for supporting a vehicle body part as claimed in claim 7, wherein said floor-mobile holder includes a lower support for upwardly supporting said door thereon, and includes a restrainer disposed above said lower support for engaging said door and preventing tipping of said door off said lower support.

* * * * *